US005921210A

United States Patent [19]

Regueiro

[11] Patent Number: 5,921,210

[45] Date of Patent: Jul. 13, 1999

[54] TAPPET ASSEMBLY FOR THE VALVE TRAIN OF AN INTERNAL COMBUSTION ENGINE

[75] Inventor: Jose F. Regueiro, Rochester Hills, Mich.

[73] Assignee: Chrysler Corporation, Auburn Hills, Mich.

[21] Appl. No.: 09/151,049

[22] Filed: Sep. 10, 1998

[51] Int. Cl.[6] ..... F01L 1/02

[52] U.S. Cl. ..... 123/90.22; 123/90.27; 123/90.48

[58] Field of Search ..... 123/90.22, 90.23, 123/90.27, 90.48, 90.52

[56] References Cited

U.S. PATENT DOCUMENTS 5,626,110 5/1997 Regueiro ..... 123/90.22
5,638,783 6/1997 Regueiro ..... 123/90.22
5,645,023 7/1997 Regueiro ..... 123/90.27
5,669,344 9/1997 Regueiro ..... 123/90.22
5,682,849 11/1997 Regueiro ..... 123/90.22

FOREIGN PATENT DOCUMENTS 58-202316 11/1983 Japan .

*Primary Examiner*—Weilun Lo
*Attorney, Agent, or Firm*—Kenneth H. Maclean

[57] ABSTRACT

A tappet assembly for use with a valve train mechanism of an internal combustion engine that has angulated intake and exhaust valves actuated by the lobes of a pair of camshafts characterized in that the lobe of each camshaft serves to move the associated valve through an inverted bucket tappet incorporating a cylindrical force transmitting element which includes a surface that is skewed or inclined with respect to the bottom of the body of the tappet.

16 Claims, 3 Drawing Sheets

TAPPET ASSEMBLY FOR THE VALVE TRAIN OF AN INTERNAL COMBUSTION ENGINE

FIELD OF INVENTION

This invention concerns internal combustion engines and, more particularly, relates to an engine valve train mechanism having angulated intake and exhaust valves extending from a curved upper wall of the combustion chamber and having an actuator for moving the intake and exhaust valves through a tappet assembly provided with a cylinder type force-transmitting member.

BACKGROUND OF THE INVENTION

Japanese Patent No. 58-202316(A), issued on Nov. 25, 1983 in the name of Shiyouichi Honda discloses a double-overhead camshaft valve train mechanism using upper and lower tappets to operate each of the intake valves and the exhaust valves. The lower tappet abuts the stem tip of the associated valve and is of conventional inverted bucket design without an adjusting shim. The upper tappet is disposed with its bottom end abutting the lower tappet with its upper end in contact with the cam lobe of the camshaft. The top surface of the upper tappet is square with the tappet's longitudinal center axis, however, the bottom surface is inclined or at an angle to the top surface of the tappet. As a result, the reciprocating operational axes of both the upper and lower tappets are disposed at an angle to each other.

The lower tappet of the above mentioned valve train mechanism is supported for reciprocating movement by a tappet guide bored within the cylinder head of the engine. The upper tappet is similarly supported for reciprocating movement in a separate tappet carrier which is fastened to the top of the cylinder head and has a cylindrical structure with the center axes of both its internal bore (defining the tappet guide) and the external cylindrical hub disposed offset from each other. The carrier is formed with an ear which is slotted in a section of an arc concentric with the cylindrical hub. A set-screw passes through the slotted ear and is threaded in a portion of the cylinder head structure. Adjustment of the valve lash is realized by loosening the set-screw and rotating the tappet carrier so as to shift the axis of the upper tappet with respect to the axis of the lower tappet and, thereby, change the effective length of the upper tappet. Afterwards, the set-screw is re-tightened to maintain the tappet carrier in the adjusted position.

One problem with the mechanism shown in the above-mentioned Japanese patent is that the diameter of the upper tappet must be larger than geometrically required to avoid the top edges of the tappet being engaged by the flanks of the cam lobe of the camshaft. The large diameter of the upper tappet also contributes to increase its weight and forces an increase of the diameter of the lower tappet. Following the rule of thumb that in cylindrical elements such as tappets the weight increases as the cube of the diameter, my calculations (based on the patent drawings) show that the mechanism would be 4.13 times larger than a simple 34 mm tappet. This increase in dynamic mass and inertia would force the use of a longer and stiffer spring with still more mass and considerable more force.

Another problem with the Japanese mechanism described above is that the upper tappet in contact with the camshaft cannot rotate on its own axis and has no top shim wear pad to allow rotation with respect to the camshaft. It is well known that inverted bucket tappets, just as any other cam following devices, should rotate or have hardened top shims capable of rotation so as to minimize wear during its contact with the camshaft lobe. In addition, the non-rotational upper tappet, having to contend with the sideways camshaft lobe forces plus the sideways forces generated by its lower skewed edge being urged by the much-stronger spring, will tend to generate extra heat and wear at its transversal contact points with its guide structure.

SUMMARY OF THE INVENTION

In the preferred form, the tappet assembly according to the present invention is utilized with valve train mechanisms incorporated in a cylinder head of an internal combustion engine having essentially hemispherical combustion chambers each of which have four valves with the valve stems positioned normal to the upper hemispherical surface of the combustion chamber. This novel tappet assembly has some structural similarities to the tappet assembly disclosed in the above-mentioned patent, however, it differs therefrom in that it serves to actuate the tappets located above the valves directly through a cylindrical element or joint which includes a surface that is skewed or inclined with respect to the bottom of the tappet or the top of the valve stem. The cylindrical element is not a tappet of the type used in the above mentioned patent but, instead, is a small part of the tappet that hardly increases the height or mass of the tappet or the valve train mechanism. Another difference is that the tappet assembly according to the present invention allows free independent rotation of both the valve and the tappet so as to minimize wear.

In one version of the tappet assembly made in accordance with the present invention, the cylindrical element of the tappet is disposed within a cylindrical lower extension formed co-axially with the tappet. The extension can be integrally formed with the body of the tappet or made as a separate part which is secured in place.

In another version of the tappet assembly, the cylindrical element is positioned directly over the top of the valve stem surrounding it as a cap. In this case, the skewed end of the cap abuts the bottom of the inverted bucket tappet.

Stated broadly, the present invention provides a tappet assembly for a valve train of an internal combustion engine having an engine block with cylinders therein with a cylinder head secured to the block. Each of the cylinders have first and second intake valves and first and second exhaust valves associated with the cylinder. Each of the valves has an elongated stem portion terminating at its upper end with a flat contact surface lying in a plane perpendicular to the longitudinal center axis of the stem portion and each of the center axes of the stem portions are radially disposed with respect to one another and arranged so that each axis diverges away from the center axis of other stem portions. The tappet assembly according to the present invention includes an inverted bucket tappet located adjacent the upper portion of each valve stem portion and supported by the cylinder head for movement along an axis which is angulated with respect to the center axis of an associated valve stem portion. Each of the inverted bucket tappets comprises a disk portion at its upper end integrally formed with a depending skirt portion. The disk portion has an outer surface and an inner surface the latter of which is in contact with a cylindrical force transmitting element of a diameter substantially less than the diameter of the skirt portion of the associated inverted bucket tappet. The cylindrical element is characterized in that it is provided with a surface between the valve stem and the bottom of the tappet that is skewed so as to be located in a plane inclined to the plane of the outer surface of the disk portion whereby the transversal plane motion of the inverted bucket tappet is converted into the radial motion of the valves.

BRIEF DESCRIPTION OF THE DRAWINGS

The above and other features and advantages of the present invention will be more apparent from the following detailed description when taken with the drawings in which.

DETAILED DESCRIPTION OF THE DRAWINGS

Figure 1:
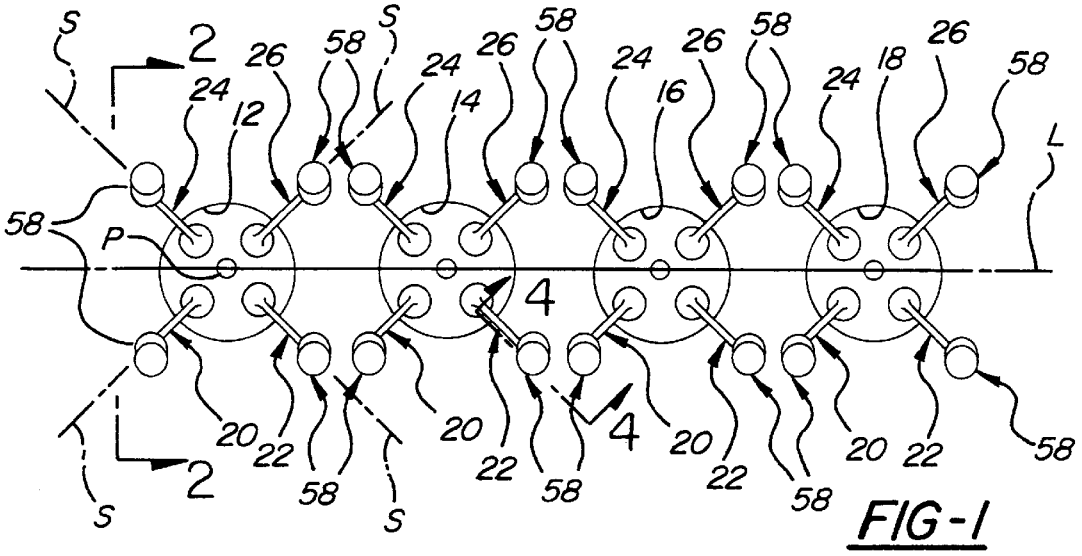
FIG. 1 is a diagrammatic top view of a multi-valve four cylinder internal combustion engine incorporating a tappet arrangement made in accordance with the present invention.

Referring to the drawings and more particularly FIG. 1 thereof, a diagrammatic top view of a cylinder and valve arrangement is shown of a multi-valve four cylinder in-line internal combustion engine 10 in which the valve train mechanism at each cylinder 12, 14, 16, and 18 incorporates tappet assemblies made in accordance with the present invention. At each 12–18 of the engine 10, a pair of radial intake valves 20 and 22 and a pair of radial exhaust valves 24 and 26 are provided that, as seen in FIGS. 2 and 3, are located along axes which are inclined with respect to one another and arranged so that the axis of each valve diverges away from the axes of adjacent valves.

Figure 2:
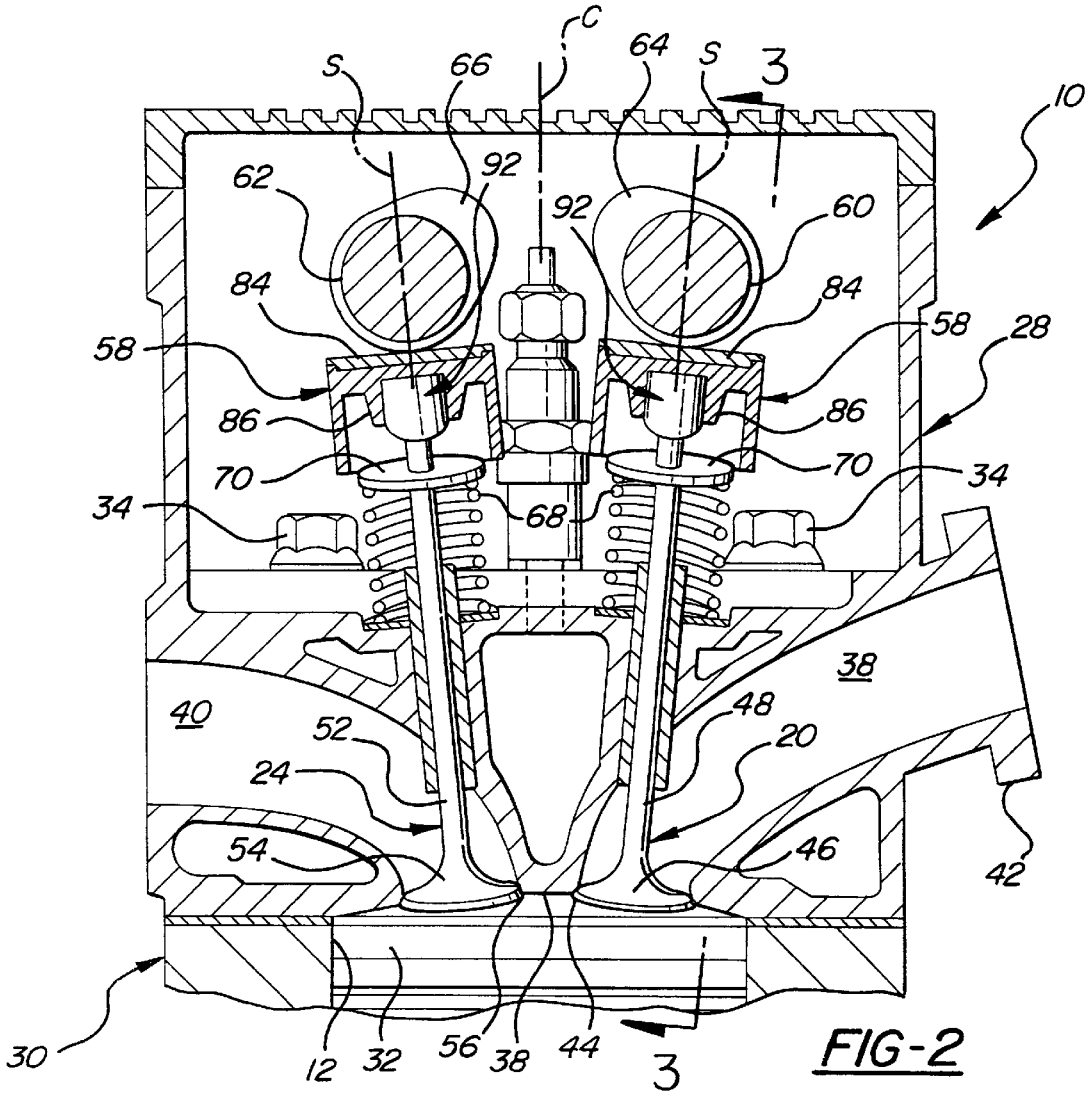
FIG. 2 is an enlarged partly sectioned view taken on line 2—2 of FIG. 1 showing a portion of a valve train mechanism employing the tappet arrangement made in accordance with the present invention.

As seen in FIG. 2, a cross sectional view of the upper portion of the engine 10 of FIG. 1 is shown as including a cylinder head 28 located on top of an engine block 30 with cylinder 12 being visible. A piston 32 is mounted in the cylinder 12 for reciprocating linear motion and, as well known in the engine art, the piston 32 is connected to a crankshaft (not shown) by a connecting rod (not shown). The cylinder head 28 is secured to the block by a plurality of threaded fasteners 34, and is formed with a concave wall 36 which defines a substantially hemispherical combustion chamber. The wall 36 is aligned with the cylinder and is of substantially the same diameter. The hemispherical concave wall 36 cooperates with the upper surface of the piston 32 and with the circular side wall of the cylinder 12 to define an expandable and contractible combustion chamber.

The cylinder head 28 is provided with air intake and gas exhaust passages 38 and 40 located respectively on either side of a longitudinally extending mid-plane (normal to the plane of FIG. 2) which plane passes through a longitudinal center axis "L" of the engine 10 as seen in FIG. 1. Air intake passage 38 originates at a flanged entrance 42 at one side of the cylinder head 28 to an annular air inlet opening 44 leading into the combustion chamber. The peripheral edge of the inlet opening 44 has an inwardly tapered configuration forming an annular sealing seat. As seen in FIGS. 2 and 3, the seat is engaged by an enlarged head portion 46 of the intake valve 20. It should be noted that the intake valve 20 is one of a pair of identical intake valves the other of which is shown in FIG. 3 and identified by the reference numeral 22.

Figure 3:
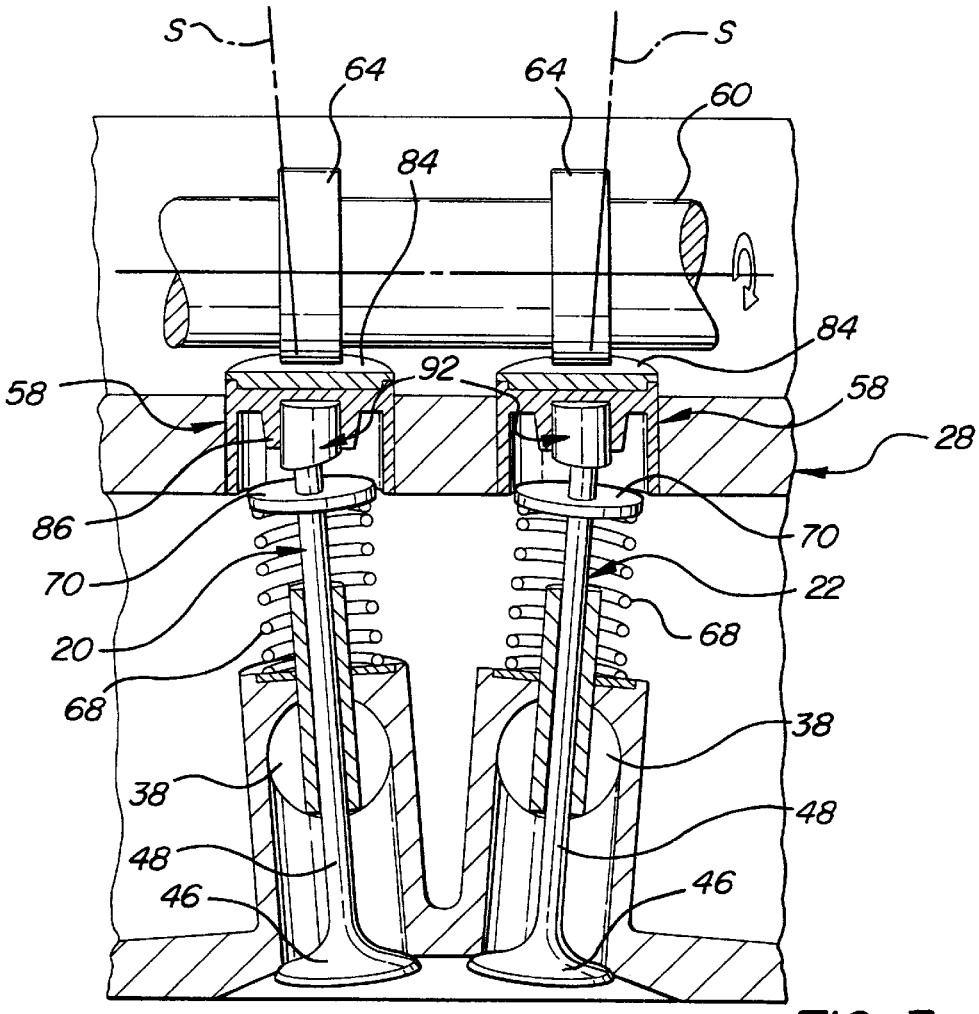
FIG. 3 is a sectional side view taken on line 3—3 of FIG. 2 showing the pair of intake valves of the valve train mechanism at one of the cylinders of the engine of FIG. 1.
Figure 4:
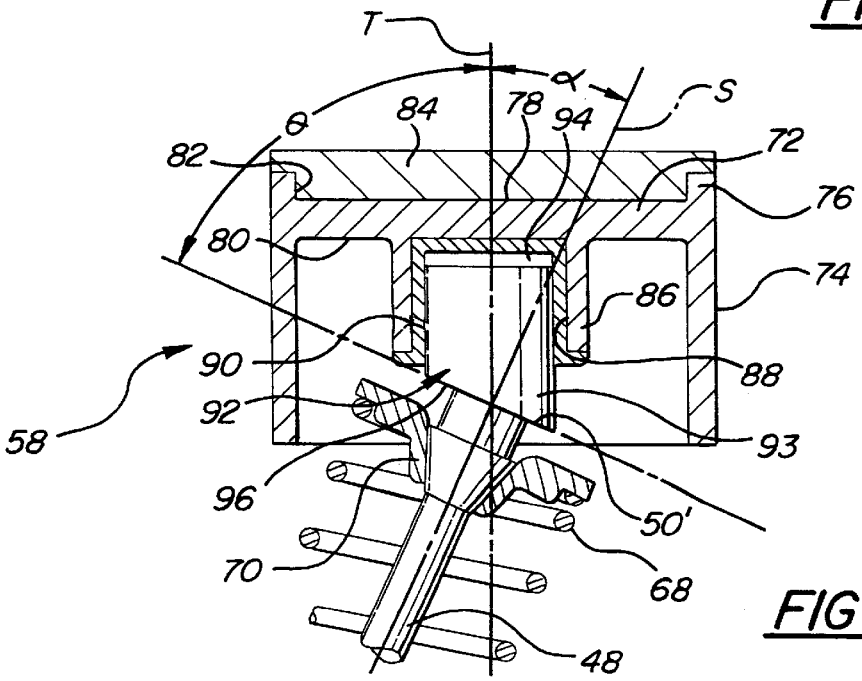
FIG. 4 is an enlarged sectional view taken on line 4—4 of FIG. 1 of one of the tappet assemblies incorporated with one of the intake valves of the valve train mechanism shown in FIGS. 2 and 3.

As best seen in FIGS. 3 and 4, each intake valve 20 and 22 of each 12–18 has an elongated stem portion 48 that extends upwardly from its head portion 46 and terminates at a tip having a planar surface 50 which is normal to the longitudinal center axis "S" of the stem portion 48. Similarly, each of the exhaust valves 24 and 26 at each cylinder 12–18 has a stem portion 52 that extends upwardly from a valve head 54 located in an annular exhaust outlet opening 56 and terminates at a tip having a planar surface 50 which is normal to the longitudinal center axis of the stem portion 52.

As seen in FIGS. 1 and 2, the longitudinal center axis "S" of each stem portion 48 and 52 essentially extends from a point P located on the center vertical axis C of the associated cylinder and below the piston 32. In this regard, it will be noted that the stem portions of the intake valves 20 and 22 and of the exhaust valves 24 and 26 at each cylinder 12–18 are disposed radially about the cylinder head 28 such that the intersection of their longitudinal center axes occurs essentially at the point P. As a result, the centers of the valve head portions 46 and 54 of the intake and exhaust valves 20–26 are located essentially on a common circle concentric with the periphery of the associated cylinder. In addition, the centers of the valve heads are essentially circumferentially equally spaced from each other. Also, each of the valve heads 46 and 54 is in an essentially tangential plane relative to the hemispherical recess. Thus, the longitudinal center axis S of each valve 20–26 at each cylinder 12–18 is preferably canted at an equal angle to both the longitudinal and transversal planes of the engine 10. This orientation not only allows for more room at the top of the cylinder and lessens the space requirements for valves, spark plugs, injectors, prechambers, cooling jackets, and casting requirements for the cylinder head, but also produces a far superior combustion chamber with preferably optimum central location of the spark plug or injector. It will be noted that in cases where the size of the valve heads may differ from each other, the intersection of the longitudinal center axis of some of the valves with the vertical center axis of the associated cylinder may be below or above the common point P mentioned above.

As seen in FIGS. 2 and 3, each of the valves 20–26 is operatively associated with an identical tappet assembly 58 which is reciprocally mounted in a bore formed in the cylinder head 28 for sliding reciprocating movement along an axis "T" as seen in FIG. 4. A pair of laterally spaced camshafts 60 and 62 are mounted for rotation in journals (not shown) formed in a laterally extending portion of the cylinder head 28. As the camshafts 60 and 62 rotate, cam lobes 64 and 66 slide over the upper surface of the tappet assembly 58 associated with each of the valves 20–26. The rotational movement of the cam lobes 64 and 66 across the upper surface of the associated tappet assembly 58 causes downward displacement of the latter compressing a helical spring 68 operatively associated with each valve. The spring 68 extends between the upper surface of the cylinder head 28 and a retainer disc 70 secured to the associated valve stem by a keeper or lock. The actuation force of the camshaft causing the valve to open is transmitted through the tappet assembly 58 to the associated valve stem. The resultant force transmission through the valve stem moves the valve head from its seat to an opened position. As the camshaft lobe 64, 66 slides past their maximum lift point, the compressed spring 68 releases energy to move the valve back to its closed position wherein the valve head is seated in the seat.

As seen in FIGS. 2 through 5, each tappet assembly 58 associated with the intake valves 20, 22 and the exhaust valves 24, 26 takes the form of an inverted bucket tappet the main body of which includes a disk portion 72 surrounded by and integrally formed with a depending cylindrical skirt portion 74. The skirt portion 74 includes an annular rim section 76 which extends above the disk portion 72. The disk portion 72 has an outer planar surface 78 and an inner planar surface 80 located in substantial parallel planes and the rim section 76 cooperates with the outer planar surface 78 to define a cylindrical recess 82 therewith. A stepped or double diameter shim 84 is located in the recess 82 and takes the form of the shim as shown in my U.S. Pat. No. 5,445,119 issued on Aug. 29, 1995. A conventional thinner, single diameter shim can be installed in the recess 82 in lieu of the shim 84. In each case, the shim could rotate about the longitudinal center axis T relative to the surface 78 during operation of the valve train mechanism so as to minimize wear during contact with the camshaft lobes.

The shim 84 could be omitted if desired in which case the rim section 76 of the skirt portion 74 extending above the outer surface 78 of the disk portion 72 would not be needed. In the case where the shim is omitted, the tappet body consisting of the disk portion and the integral skirt portion would rotate about the longitudinal center axis T of the tappet assembly relative to the cylindrical element 92 during operation of the valve train mechanism to minimize wear while in contact with the camshaft lobes.

As seen in FIGS. 2–4, an extension 86 is integrally formed with the inner planar surface 80 of the disk portion 72 and serves to define a cylindrical cavity 88 with its longitudinal center axis co-axial with the longitudinal center axis "T" of the skirt portion 74 of the tappet assembly 58. As best seen in FIG. 4, a replaceable thimble-shaped metal bushing 90 is located within the cavity 88 and accommodates a cylindrical element 92. The cylindrical element 92 includes a hollow member 93 with its top open end closed by an annular cap 94. The cylindrical element 92 can be made of a metallic material with the cap 94 abutting the inside top end of the bushing 90. In the alternative, the cylindrical element can be made of a ceramic material as will be explained hereinafter. The cap 94 is stepped in design for alignment with the lower hollow member 93 of the cylindrical element 92.

As seen in FIG. 4, the opposite end of the cylindrical element 92 has a lower planar surface 96 which is formed at an angle to the longitudinal center axis "T" and abuts the flat top surface 50 of the tip of the associated valve stem. According to the present invention, the planar surface 96 will always lie in a plane that is normal to the longitudinal center axis of the associated valve stem and be in surface-to-surface contact with surface 50. Accordingly, when the tappet assembly 58 is inclined with respect to the axial center line of the valve stem in both the longitudinal and transverse planes of the engine as shown in FIGS. 1–3 and in all other cases when the tappet assembly is used with angulated valves, the angle "theta" formed between the lower surface 96 of the cylindrical element 92 and the longitudinal centerline T of the cylindrical element 92 will be equal to the difference between the angle "alpha" defined by the longitudinal center line of the valve stem S and the longitudinal centerline T of the tappet assembly 58 and 90 degrees.

In operation, each tappet assembly 58 reciprocates within its cylindrical guide bore formed in the cylinder head 28. The downward reciprocating stroke of the tappet assembly 58 follows the motion of the associated cam lobe as the latter contacts the top surface of the shim 84. The downward motion of the tappet assembly 58 is transmitted to the associated valve through the cylindrical element 92 to open the associated valve. As the tappet assembly 58 and the associated valve are displaced from a closed position to the opened position, the flat lower surface 96 of the cylindrical element 92 slides sideways with respect to the flat surface 50 of the valve stem tip due to the angularity between the longitudinal center axis S of the valve stem and the longitudinal center axis T of the tappet assembly 58. After the spring 68 causes the valve to return to its seated or closed position, a gap or valve lash is created between the top surface of the shim 84 and the base circle of the cam lobe. In this regard, a mechanical lash-setting through the use of the shim 84 is provided and the formed gap is used to compensate for the operational thermal expansions and contractions of the valve train. To compensate for manufacturing tolerances and to accommodate for operational wear of the different elements of the valve train, one element in the force transmission line of the valve stem may be made with different but controlled dimensions (thickness). This selectively dimensioned element is used to establish a desired valve lash during engine assembly and also during service so as to compensate for wear, re-machining of the valve seat, introduction of replacement parts, etc. In this case, the shim 84 is selected as the element used in varying the "thickness" of the force transmission line and can be used as a replaceable wear pad.

Inasmuch as the position of the cylindrical element 92 has its angulated or skewed surface 96 in surface-to-surface contact with the flat surface 50 of the valve stem, the cylindrical element 92 does not rotate in operation even though the shim and/or tappet body (disk portion and skirt portion) may rotate. However, during operation of the engine, the cylindrical element 92 may reciprocate slightly as mechanical continuity of the valve train's parts is lost after the associated valve is seated. This creates lash which, in turn, is lost as the mechanical continuity is again restored just before the valve begins to open again in the successive cycle. In any case, even if the cylindrical element 92 reciprocates along its axis for the total value of the lash during the dwell period, the motion is not under load and no heat will be generated. Moreover, the inherent splashing of oil occurring in a typical valve train will provide sufficient lubrication of the parts.

Figure 5:
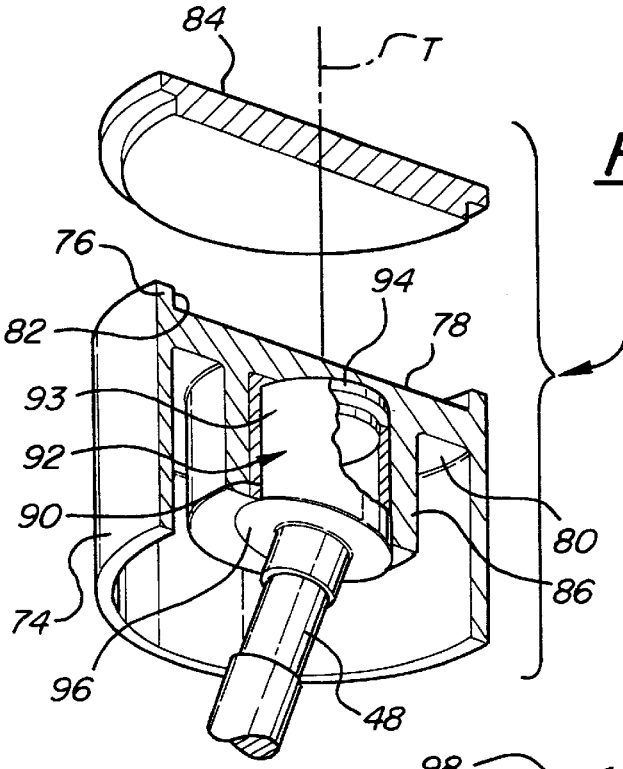
FIG. 5 is an isometric view of the tappet assembly seen in FIG. 4.

It will be noted that as seen in FIG. 5, and as alluded to hereinbefore, the cylindrical element 92 consists of two parts; one part 93 which is cup-shaped and hollow and the other part taking the form of a stepped disk that serves as the cap 94 that is aligned with the hollow part by reason of the stepped design. Making the cylindrical element 92 in this manner serves to provide a force transmitting member that is of minimum weight. Alternatively, the cylindrical element can be made solid if made of a light-weight material such as ceramics.

Figure 6:
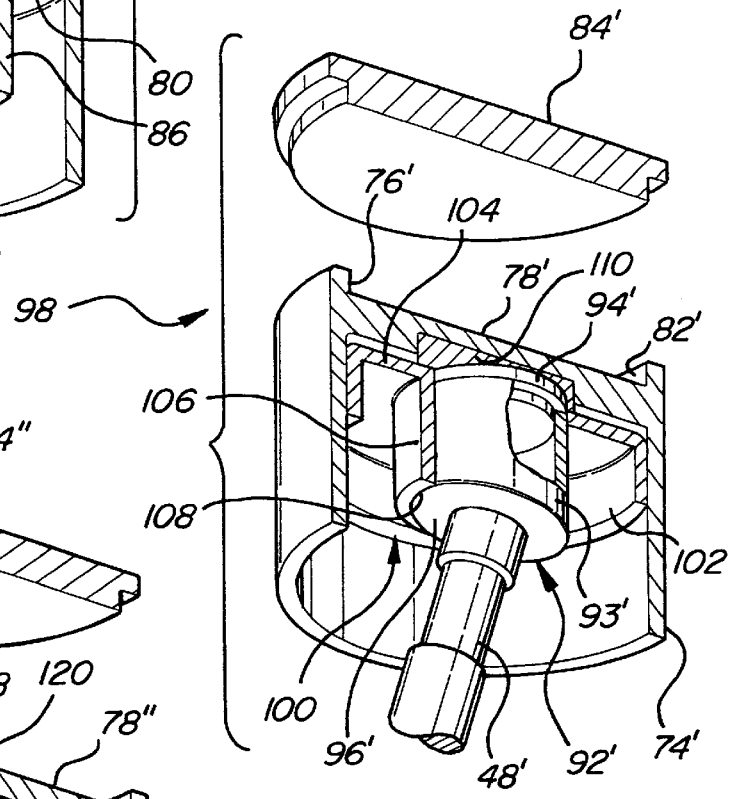
FIG. 6 is an isometric view of a modified version of the tappet member shown in FIGS. 4 and 5.

FIG. 6 shows a modified version of the tappet assembly 58 seen in FIGS. 1–5 and, accordingly, those parts of the tappet assembly 98 shown in FIG. 6 that are identical to the parts of the tappet assembly 58 are identified by the same reference numerals but primed. With reference to FIG. 6, it will be noted that a separate carrier 100 for the cylindrical element 92' is provided which can take the form of a low-cost metal stamping. The carrier 100 comprises an outer cylindrical rim 102 rigidly connected to the outer periphery of a washer-shaped intermediate section 104 which, in turn, is connected to a cylindrical hub 106. The hub 106 defines an inner cylindrical cavity 108 in which the cylindrical element 92' is located. The cavity 108 is open at its upper end to allow the cap portion 94' of the cylindrical element 92' to abut a hardened pad 110 inserted in the lower surface of the disk portion of the tappet assembly 98. The carrier 100 is designed so that the rim 102 is frictionally or otherwise secured to the inner cylindrical surface of the skirt portion 74' of the tappet assembly 98.

Figure 7:
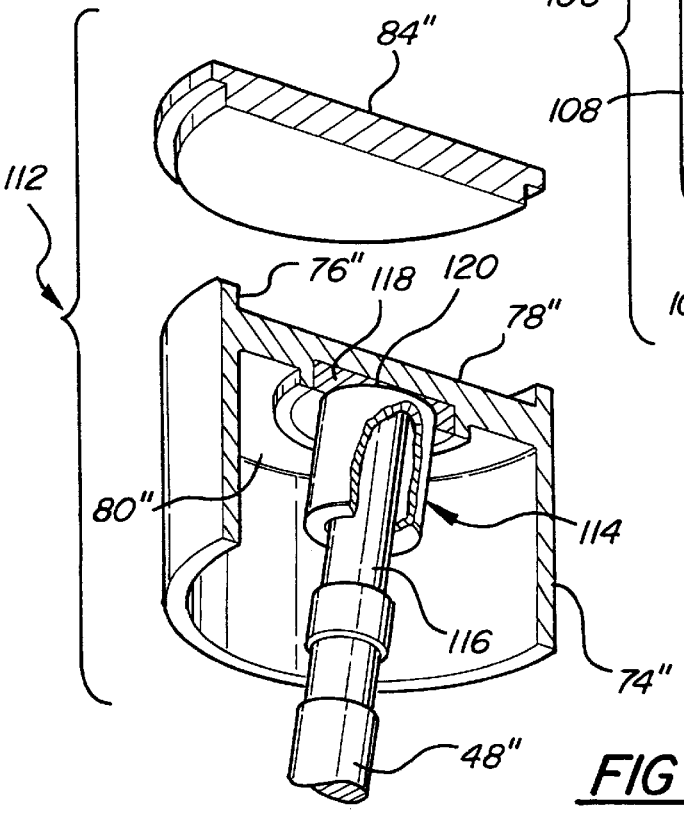
FIG. 7 is an isometric view of a another version of the tappet member seen in FIGS. 4 and 5.

FIG. 7 discloses another version of the tappet assembly 58 seen in FIGS. 1–5. The parts of the tappet assembly 112 of FIG. 7 corresponding to the parts of the tappet assembly 58 are identified by the same reference numerals but double primed.

In this regard, the tappet assembly 112 of FIG. 7 includes a cylindrical element 114 which takes the form of a hollow cup-shaped member that is positioned as a cap over an integral extension 116 of the valve stem tip. The upper outer surface of the cylindrical element 114 abuts a hardened wear pad 118 inserted in the bottom surface 80" of the disk portion 78". Rather than having the lower surface of the cylindrical element 114 angled or inclined as in the case of the cylindrical element 92 and 92' shown respectively in FIGS. 5 and 6, in this case the top surface 120 of the cylindrical element 114 is cut at the predetermined angle for cooperative engagement with the wear pad 118. During the reciprocating movement of the tappet assembly 112, the flat top surface 120 of the cylindrical element 114 is displaced sideways in relation to the flat bottom surface of the wear pad 118 in a manner as explained hereinbefore. In this arrangement, the tappet assembly 112 and the cylindrical element 114 need not be located concentrically to each other at any point during the operational displacement of the tappet assembly 112 because the outside diameter of the cylindrical element 114 is significantly smaller than the inside diameter of the skirt portion 74". This is true also because the location of the contact patch of the cylindrical element 114 and the wear pad 118 changes during operation of the valve train mechanism. By allowing the tappet body to be located offset centrally from the centerline of the valve stem 48", design flexibility is enhanced; a feature which may be critical in the design of an engine using the present invention.

While several embodiments of the invention have been disclosed and described, other embodiments are contemplated and will become apparent to those skilled in the art. Accordingly, the inventor does not wish to be limited to only the invention as shown and described but only by the scope of the following claims.

The embodiments of the invention in which an exclusive property or privilege is claimed are defined as follows:

1. A tappet assembly for a valve train mechanism of an internal combustion engine having an engine block with cylinders therein and a cylinder head, first and second intake valves and first and second exhaust valves associated with each cylinder, each of said valves having an elongated stem portion terminating at its upper end with a flat contact surface lying in a plane perpendicular to the longitudinal center axis of said stem portion, each of said center axes of said stem portions being radially disposed with respect to one another and arranged so that each axis diverges away from the center axis of other stem portions, said tappet assembly including an inverted bucket tappet located adjacent said upper portion of each valve stem portion and being supported by said cylinder head for movement along an axis which is angulated with respect to the center axis of an associated valve stem portion, said inverted bucket tappet including a body comprising a disk portion at its upper end integrally formed with a depending skirt portion, said disk portion having an outer surface and an inner surface, and a cylindrical force transmitting element located within the confines of said skirt portion and provided with a surface between the valve stem and the inner surface of the disk portion that is skewed so as to be located in a plane inclined to the plane of said outer surface of said disk portion whereby the motion of the tappet body is converted into radial motion of the associated valve during operation of the valve train mechanism.

2. The tappet assembly of claim 1 wherein the inner surface of said disk portion is provided with an extension defining a cylindrical cavity for accommodating said cylindrical element.

3. The tappet assembly of claim 2 wherein the longitudinal center axis of said skirt portion of said inverted tappet bucket is common with the longitudinal center axis of said cylindrical cavity.

4. The tappet assembly of claim 2 wherein said extension is integrally formed with said disk portion of said inverted bucket tappet.

5. The tappet assembly of claim 2 wherein said extension is a separate member secured to said skirt portion of said inverted bucket tappet.

6. The tappet assembly of claim 2 wherein a bushing supports said force transmitting element within said cavity of said extension.

7. The tappet assembly of claim 2 wherein said force transmitting member is hollow and cup-shaped in cross section with its open end facing said inner surface of said disk portion of said inverted bucket tappet.

8. The tappet assembly of claim 2 wherein the diameter of said cylindrical cavity is substantially less than the diameter of the outer cylindrical surface of said skirt portion of said inverted bucket tappet.

9. The tappet assembly of claim 2 wherein the lower surface of the cylindrical force transmitting element is inclined and has surface-to-surface contact with the flat top surface of the associated valve stem.

10. The tappet assembly of claim 1 wherein the cylindrical force transmitting element takes the form of a sleeve mounted on the stem portion of the associated valve.

11. The tappet assembly of claim 10 wherein the upper surface of said cylindrical force transmitting element is inclined relative to the outer surface of the disk portion and contacts the inner surface of the disk portion.

12. A tappet assembly for a valve train mechanism of an internal combustion engine having an engine block with cylinders therein and a cylinder head, first and second intake valves and first and second exhaust valves associated with each cylinder, each of said valves having an elongated stem portion terminating at its upper end with a flat contact surface lying in a plane perpendicular to the longitudinal center axis of said stem portion, a spring operatively associated with each of said valves for maintaining said each of said valves in a closed position, each of said center axes of said stem portions being radially disposed with respect to one another and arranged so that each axis diverges away from the center axis of other stem portions, said tappet assembly including an inverted bucket tappet located adjacent said upper portion of each valve stem portion and being supported by said cylinder head for movement along an axis which is angulated with respect to the center axis of an associated valve stem portion, said inverted bucket tappet including a body comprising a disk portion at its upper end integrally formed with a depending skirt portion, said disk portion having an outer surface and an inner surface the latter of which has an extension projecting downwardly therefrom and defining a cylindrical cavity, a cylindrical force transmitting element located in said cavity and having an upper surface and a lower surface, said lower surface of said force transmitting element being located in a plane inclined to the plane of said outer surface of said disk portion and having surface-to-surface contact with said flat contact surface at said upper end of said stem portion, and an actuator operatively connected to said inverted bucket tappet for moving the associated valve through said force transmitting element to an open position against the bias of the associated spring.

13. A tappet assembly for a valve train of an internal combustion engine having an engine block with cylinders therein and a cylinder head, a piston disposed in each of said cylinders, each of said cylinders and said piston therein defining a first end portion of a combustion chamber, said cylinder head disposed on said engine block and having curved recesses therein aligned with said cylinders to define second end portions of said combustion chambers, each of said combustion chambers having first and second intake valves and first and second exhaust valves supported by said cylinder head and associated with each cylinder, each of said valves having an elongated stem portion terminating at its upper end with a flat contact surface lying in a plane perpendicular to the longitudinal center axis of said stem portion, valve seats formed in said cylinder head for each of said valves, the lower end of each of said stem portions having an enlarged head portion for sealing engagement with an associated one of said valve seats, a spring operatively associated with each of said valves for maintaining said head portion of said each of said valves in a closed position with respect to the associated valve seat, each of said center axes of said stem portions being inclined with respect to one another and arranged so that each axis diverges away from the center axis of other stem portions, said tappet assembly including an inverted bucket tappet located adjacent said upper portion of each valve stem portion and being supported by said cylinder head for movement along an axis which is angulated with respect to the center axis of an associated valve stem portion, said inverted bucket tappet comprising a disk portion at its upper end integrally formed with a depending skirt portion, said disk portion having an outer surface and an inner surface the latter of which has an extension projecting downwardly therefrom and defining a cylindrical cavity, a cylindrical force transmitting element located in said cavity and having an upper surface and a lower surface, said lower surface of said force transmitting element being located in a plane inclined to the plane of said outer surface of said disk portion and having surface-to-surface contact with said flat contact surface at said upper end of said stem portion, and an actuator operatively connected to said inverted bucket tappet for moving the associated valve through said force transmitting element to an open position against the bias of the associated spring.

14. The tappet assembly of claim 13 wherein said actuator is a camshaft supported for rotation by said cylinder head, said camshaft having a lobe portion corresponding to each of said inverted bucket tappets wherein said lobe portions engage said tappets at contact surfaces which extend in a plane parallel to the centerline of the camshaft, said engagement of said camshaft lobe with said inverted bucket tappet during rotation of said camshaft produces movement of said tappet along its axis to cause the associated valve to move to said open position against the bias of the associated spring.

15. The tappet assembly of claim 14 wherein every valve associated with a particular cylinder is angled with respect to the centerline of said cylinder an equal amount in both the longitudinal and the transversal directions of the engine.

16. The tappet arrangement of claim 14 wherein said recesses in said cylinder head have a hemispherical configuration and said valve axes radiate outwardly from the surface of said hemispherically configured combustion chamber with said head portions of said valves disposed tangentially to the surface of said hemispherical combustion chamber.

* * * * *